US007629098B2

(12) United States Patent
Matsumura et al.

(10) Patent No.: US 7,629,098 B2
(45) Date of Patent: Dec. 8, 2009

(54) METHOD OF PRODUCING TONER FOR DEVELOPING ELECTROSTATIC CHARGE IMAGE, TONER FOR DEVELOPING ELECTROSTATIC CHARGE IMAGE, DEVELOPER FOR ELECTROSTATIC CHARGE IMAGE AND METHOD FOR FORMING IMAGE

(75) Inventors: Yasuo Matsumura, Kanagawa (JP); Hirotaka Matsuoka, Kanagawa (JP); Satoshi Hiraoka, Kanagawa (JP); Yuki Sasaki, Kanagawa (JP); Fumiaki Mera, Kanagawa (JP); Hideo Maehata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 353 days.

(21) Appl. No.: 11/345,307

(22) Filed: Feb. 2, 2006

(65) Prior Publication Data

US 2007/0092822 A1 Apr. 26, 2007

(30) Foreign Application Priority Data

Oct. 24, 2005 (JP) ..... 2005-307929

(51) Int. Cl.
*G03G 9/087* (2006.01)

(52) U.S. Cl. ..... 430/109.4; 430/110.3; 430/124.1; 430/137.14

(58) Field of Classification Search ..... 430/109.4, 430/137.14, 110.3, 124.1
See application file for complete search history.

(56) References Cited

U.S. PATENT DOCUMENTS 4,355,154 A 10/1982 Saam et al.
2003/0091924 A1* 5/2003 Daimon et al. ..... 430/124
2003/0104296 A1* 6/2003 Hamano et al. ..... 430/107.1
2006/0216623 A1* 9/2006 Matsumura et al. ..... 430/108.1
2006/0216625 A1* 9/2006 Maehata et al. ..... 430/109.3

FOREIGN PATENT DOCUMENTS

| | | |
|---|---|---|
| JP | A 63-282752 | 11/1988 |
| JP | A 06-250439 | 9/1994 |
| JP | A 10-001536 | 1/1998 |
| JP | A 2002-351140 | 12/2002 |
| JP | A 2003-050478 | 2/2003 |
| JP | A 2004-206081 | 7/2004 |

* cited by examiner

*Primary Examiner*—John L Goodrow
(74) *Attorney, Agent, or Firm*—Oliff & Berridge, PLC

(57) ABSTRACT

A method of producing a toner for developing electrostatic charge image, the method comprising: aggregating particles containing a crystalline polyester resin, particles containing a non-crystalline polyester resin and particles of a releasing agent in an aqueous medium, so as to form aggregated particles; and heating the aggregated particles to fuse into a coalescent body, wherein at least one of the crystalline polyester resin and the non-crystalline polyester resin is obtained by polymerization at temperatures not higher than 150° C. with a Bronsted acid containing a sulfur atom as a catalyst, and wherein a first onset temperature A(° C.) of the toner and a glass transition temperature B(° C.) of the non-crystalline polyester resin as measured by differential scanning calorimeter satisfy a relation $(B-A) \leqq 10$, and wherein a weight average molecular weight of the crystalline polyester resin is ½ or lower of a weight average molecular weight of the non-crystalline polyester resin.

17 Claims, No Drawings

METHOD OF PRODUCING TONER FOR DEVELOPING ELECTROSTATIC CHARGE IMAGE, TONER FOR DEVELOPING ELECTROSTATIC CHARGE IMAGE, DEVELOPER FOR ELECTROSTATIC CHARGE IMAGE AND METHOD FOR FORMING IMAGE

BACKGROUND OF THE INVENTION

1. Field of the Invention

The present invention relates to a toner for developing electrostatic charge image which is used in appliances employing electrophotographic processes employed in copiers, printers, facsimiles, and the like, and particularly, color copiers; it also relates to a method for producing the same. The present invention furthermore relates to a developer for electrostatic charge image and to a method for forming images using said toner for developing electrostatic charge image.

2. Description of the Related Art

Methods for visualizing image information via electrostatic charge image, such as an electrophotographic method, are widely used in various fields. In the electrophotographic methods, an electrostatic charge image is formed on the surface of a photosensitive body (latent image retaining body) by charging and light-exposing steps, and the electrostatic latent image is developed by a developer containing a toner, which is then visualized by transferring and fixing steps. There are two-component developer comprising a toner and a carrier, and a one-component developer using a magnetic toner or a non-magnetic toner alone; however, the toners are generally produced by kneading and crushing method comprising melting and kneading a thermoplastic resin together with a pigment, a charge controlling agent, and a releasing agent such as a wax, followed by cooling, finely crushing, and classifying. If necessary, inorganic or organic particles may be added to the surface of the toner particles in order to improve fluidity and cleaning properties of these toners.

Recently, the use of copiers, printers, and multifunction devices of copiers and printers or facsimiles employing color electrographic methods is widespread; however, in order to realize appropriate gloss in reproducing color image or transparency for excellent OHP images, it is generally difficult to use a releasing agent such as wax. Accordingly, large amount of oil has been applied to the fixing roll to assist peeling off the copy image; however, this led to cause sticky feeling on the copy images inclusive of those on OHPs, made it difficult to generate additional writings into the image using pens, and increased heterogeneity in gloss. Furthermore, the application of commonly used polyethylene, polypropylene, or waxes such as paraffin, to the general use black-and-white copies is further difficult because they impair OHP transparency.

Furthermore, if transparency should be sacrificed, for instance, it is next to impossible to suppress the toner exposure to the surface in case the toner production method using the kneading and crushing method known in the art is employed. This leads to problems when used as developers, such as a considerable loss of fluidity, causing filming in developing machines and photoreceptor, and the like.

As a method to fundamentally solve these problems, there is proposed a production method based on polymerization for controlling exposure of the waxes to the surface by internal encapsulation, which comprises dispersing, with a colorant, an oil phase containing the monomers as the starting materials of the resin, and then directly effecting polymerization in an aqueous phase to obtain a toner.

Further, as a means which enables intentionally controlling the toner shape and the surface structure, proposed in JP-A-63-282752 and JP-A-6-250439 are methods of manufacturing toners by means of emulsion polymerization aggregation method. These methods generally comprise preparing a dispersion of resin particles by emulsion polymerization while preparing a colorant dispersion by dispersing a colorant in a medium, and then mixing them together to obtain aggregated bodies of size corresponding to toner particle diameter, followed by heating to obtain a toner by fusion and coalescence.

The methods above not only realize encapsulating waxes, but also easily reduce the diameter of toners, thereby making it possible to reproduce images with higher resolution and clarity.

As described above, in electrophotographic processes, to provide high quality image and to maintain stable toner performance under various mechanical stresses, it is extremely important to not only select the pigment and releasing agents, optimize the quantities and suppress the surface exposure of the releasing agent, but also improve gloss and releasing properties under no fixing oil, while suppressing hot offset by optimizing the resin characteristics.

On the other hand, the development of a technology capable of fixing at lower temperatures is desired in order to reduce energy consumption, and recently, to enhance energy conservation in particular, it is demanded that the power supply to the fixing machine should be cut off when it is out of service. Accordingly, the temperature of the fixing machine should be instantaneously elevated to the operation temperature on switching on for power supply. To that end, it is preferred to reduce the heat capacity of the fixing machine. However, in such case, the temperature of the fixing machine tends to fluctuate too large as compared with the conventional case. In other words, the temperature overshoot becomes too large on applying electric power, and the drop of temperature on feeding paper also becomes large. Furthermore, in case a paper smaller in width than the width of the fixing machine is continuously fed, the temperature difference between the paper feeding part and the part with no paper feeding also becomes large. The phenomenon above is particularly distinctly observed when a high-speed copier or a printer is used, because the power supply tends to be insufficient. Hence, electrophotographic toners capable of fixing at lower temperatures and free of offset generation to high temperature regions, i.e., the so-called toners with wide fixing latitude, are strongly demanded.

As a means for lowering the fixing temperature of the toners, it is known to use polycondensation type crystalline resins exhibiting sharp melting behavior with temperature change for the binder resins constituting the toners. However, crystalline resins have difficulties in crushing, and are generally unfeasible in case melt-kneading and crushing method is employed.

Furthermore, in the polymerization of polycondensation type resins, a reaction lasting for 10 hours or longer under highly reduced pressure and stirring with high power input at high temperatures exceeding over 200° C. is necessary, but this leads to large energy consumption. Moreover, for this purpose, most cases require a huge equipment investment to assure durability of the reaction facilities.

In addition, in case of manufacturing the toner by emulsion polymerization aggregation method as above, the polycondensation type crystalline resin may be polymerized, emulsified in an aqueous medium to obtain latex that is then aggregated with a pigment, wax, and the like, and then fused to coalesce.

However, the emulsification of a polycondensation type resin requires a non-efficient step with high energy consumption, such as emulsifying by applying high shear force under high temperature exceeding 150° C., or dissolving in a solvent and dispersing the low viscosity solution in an aqueous medium, followed by removal of the solvent.

Furthermore, it has been found difficult to overcome the problem of hydrolysis while emulsifying in the aqueous medium, and the unavoidable generation of contingent factors remained in material design.

The problems above are distinct in crystalline resins, but these are also the case with non-crystalline resins.

For instance, in JP-A-2002-351140 is proposed a method for producing a toner for developing electrostatic charge image, which comprises manufacturing a molten body of the toner starting material by heating and melting toner starting materials containing at least a polyester resin, emulsifying the molten body in an aqueous medium to form fine resin particles, aggregating the fine resin particles, and melt-adhering them to obtain an aggregate of the fine resin particles. In this case, a well-known polycondensation catalyst such as tetrabutyl titanate was used as the catalyst for the monomers, for instance, trimellitic anhydride (TMA) as polyfunctional carboxylic acid, terephthalic acid (TPA) and isophthalic acid (IPA) as dicarboxylic acid, polyoxypropylene(2.4)-2,2-bis(4-hydroxyphenyl)propane (BPA-PO) and polyoxyethylene (2.4)-2,2-bis(4-hydroxyphenyl)propane (BPA-EO) as aromatic diols, and ethylene glycol (EG) as aliphatic diol, and the like, and the reaction was carried out at 220° C. for 15 hours under a nitrogen gas flow at an ordinary pressure, thereafter reducing pressure and continuing reaction at 10 mmHg. Thus was obtained polyester having a weight average molecular weight in a range of from about 5,000 to 90,000. Then, the polyester was molten and kneaded with a colorant, wax, and the like, and the resulting melt-kneaded product was fed into a dispersion emulsifier CAVITRON CD1010 (product of EUROTEC, LTD.) after heating to 190° C., to which 0.5 wt. % dilute ammonia water heated to 160° C. using a heat exchanger was added to CAVITRON at a rate of 1 L per minute. After dispersing, the slurry dispersion was cooled to 60° C. and taken out. For preparing the toner, the dispersion must be further agglomerated, fused, rinsed, and dried, but it is clear that that the resin production and the resin emulsification require a large amount of energy, and is therefore practically unfeasible.

Furthermore, emulsification and dispersion under such high energy conditions tend to cause decomposition of resins, and generate uneven distribution of the composition, or makes it difficult to achieve resin particles with uniform particle size distribution in the dispersion. Moreover, practical problems such as unexpected agglomeration of particles and the like occurred during the storage of the dispersion. Concerning the toners using such materials, there are problems, as a matter of course, not only on the initial image quality, but also on the image stability and the like during continuous printing.

Furthermore, recently proposed is a method of preparing polycondensation resins by dispersing polycondensing monomers in water together with a catalyst. As the report on successful polycondensation of polyester in an aqueous medium, there can be mentioned, for instance, U.S. Pat. No. 4,355,154.

However, the invention disclosed in U.S. Pat. No. 4,355,154 is still insufficient for an industrially stable production of polyesters for toner usages, because it is difficult to obtain high molecular weight polymers. The reason why it is difficult to increase the molecular weight of the polyester is, because, it is difficult to shift the equilibrium of polyester synthesis to the products side by accelerating dehydration of the monomer oil droplet dispersed in water.

There are also reports on the synthesis of polycondensation type resin in an organic solvent. For instance, JP-A-10-1536 discloses a method for producing an unsaturated polyester comprising heating an aliphatic alcohol and an aliphatic polybasic acid in an organic solvent at 100 to 200° C. to effect dehydration reaction.

However, the method of the invention disclosed in JP-A-10-1536 cannot avoid the generation of problems concerning the installation of facilities for recovering organic solvents, the environmental impact, and the like. Furthermore, the organic solvents enumerated as preferred ones, such as anisole, phenetol, and diphenyl ether, are far from being general purpose organic solvents, and are deemed as subjects of regulation. Moreover, heating to high temperatures of 150° C. or higher is necessary in case the polyester produced according to the invention is dispersed in water to make particles; this is not preferable from the viewpoint not only of energy consumption, but also of causing unintentional hydrolysis which affects fixing properties. Yet more, the particle size distribution of the resulting dispersed particles spreads to a wide range, which also affects the particle size distribution and compositional distribution of the toners produced from such particles, and made them practically unfeasible. The organic solvent used as the solvent partly remained in the toners, which affected charging and fixing properties, leading to practically unfeasible results.

In addition, in case the crystalline resin was used alone, there has been found a problem that the resulting toner had insufficient mechanical strength and charging properties. In order to solve such problems, there is proposed a toner using both of the crystalline resin and the non-crystalline resin.

For instance, JP-A-2003-50478 discloses a toner for developing electrostatic charge image containing at least a crystalline compound, a binder resin, and a colorant, and this toner for developing electrostatic charge image is characterized in that its differential scanning calorimetry curve as measured by a differential scanning calorimeter (DSC) shows a distinct endothermic peak in the temperature range of from 50 to 100° C. in the first heating process, and that this peak area decreases to ⅓ or less in the second heating process. Furthermore, JP-A-2004-206081 discloses an image forming toner containing at least a thermoplastic resin (A), a colorant (B), a wax (C), and a crystalline polymer (D), which is characterized in that, when measured with a differential scanning calorimeter, one of the DSC endothermic peak temperatures attributed to (C) and (D) shifts to the lower temperature side by 2° C. or more as compared with the DSC endothermic peak temperatures obtained by measuring (C) and (D) alone.

However, although these toners had superior low temperature fixing properties, they still had problems of generating filming on the photoreceptor during the electrophotographic processes, and, particularly, problems have been found on long term sustainability of high quality image under high temperature and high humidity conditions.

SUMMARY OF THE INVENTION

The present invention aims to solve the problems known in the related art as described above. More specifically, the present invention provides a method for producing a toner for developing electrostatic charge image having excellent low temperature fixing properties and long term preservability of high quality images. In particular, the present invention aims to provide a method for producing a toner for developing electrostatic charge image having superior long term preservability under high temperature and high humidity conditions. Further the present invention provides a toner for developing electrostatic charge image obtained by the method, an electrostatic charge image developer using the toner, and a method of forming images using the toner and the developer.

The problems above have been solved by means below.

A method of producing a toner for developing electrostatic charge image, the method comprising:

aggregating particles containing a crystalline polyester resin, particles containing a non-crystalline polyester resin and particles of a releasing agent in an aqueous medium, so as to form aggregated particles; and heating the aggregated particles to fuse into a coalescent body, wherein at least one of the crystalline polyester resin and the non-crystalline polyester resin is obtained by polymerization at temperatures not higher than 150° C. with a Bronsted acid containing a sulfur atom as a catalyst, and wherein a first onset temperature A(° C.) of the toner and a glass transition temperature B(° C.) of the non-crystalline polyester resin as measured by differential scanning calorimeter satisfy a relation $(B-A) \leqq 10$, and wherein a weight average molecular weight of the crystalline polyester resin is ½ or lower of a weight average molecular weight of the non-crystalline polyester resin.

DETAILED DESCRIPTION OF THE INVENTION

The method for producing toner for developing electrostatic charge image according to the present invention (sometimes simply referred as "toner" hereinafter) is a production method for toner for developing electrostatic charge image comprising a at least step of aggregating in an aqueous medium, particles containing a crystalline polyester resin, particles containing non-crystalline polyester resin and particles of a releasing agent; and a step of heating the aggregated particles to fuse into a coalescent body; characterized in that the crystalline polyester resin and/or said non-crystalline polyester resin is obtained by polymerization at temperatures not higher than 150° C. using a Bronsted acid containing sulfur atom as a catalyst; that the first onset temperature, A(° C.), of said toner as measured by differential scanning calorimeter and the glass transition temperature, B(° C.), of said non-crystalline polyester resin satisfy the relation $(B-A) \leqq 10$; and that the weight average molecular weight of said crystalline polyester resin is ½ or lower of the weight average molecular weight of said non-crystalline polyester resin.

In the present invention, the crystalline polyester resin and/or the non-crystalline polyester resin are/is polymerized (polycondensed) at 150° C. or lower using a Bronsted acid containing sulfur atom as a catalyst.

By polycondensing the crystalline polyester resin and/or the non-crystalline polyester resin at 150° C. or lower using a Bronsted acid containing sulfur atom as a catalyst, the energy for producing the toner as a whole can be reduced to thereby decrease environmental burden.

Preferably, both of the crystalline polyester resin and the non-crystalline polyester resin are polymerized at 150° C. or lower using a Bronsted acid containing sulfur atom as a catalyst.

In the low temperature-fixing toner containing a crystalline polyester resin, a non-crystalline polyester resin, and a releasing agent, the glass transition temperature of the toner tend to be easily lowered even though the glass transition temperature of the non-crystalline polyester resin was set at higher temperatures because of the plasticizing effect of the crystalline polyester resin and the releasing agent. This was a reason of causing image defects, because, in the electrophotographic processes, the glass transition temperature tends to become about the same or even lower than the temperature inside the device.

The present invention solves the problem above by controlling the onset temperature of the toner to fall within a temperature range of 10° C. or less from the glass transition temperature of the non-crystalline polyester resin.

Furthermore, as a result of intensive and extensive studies, the present inventors have found that an optimal compatible state for the crystalline polyester resin and the non-crystalline polyester resin can be attained by increasing the difference in molecular weight of the polymers differing in composition. The present invention has been accomplished based on those findings.

[Polyester Resin]

Polyester resins usable in the present invention can be prepared in an aqueous medium by direct esterification reaction, ester exchange reaction, and the like, using a polycondensable monomer such as, for instance, aliphatic, alicyclic, and aromatic polyfunctional carboxylic acids, alkyl esters and polyhydric alcohols, ester compounds thereof, hydroxycarboxylic acids, and the like.

In the present invention, the toner for developing electrostatic charge image contains a crystalline polyester resin and a non-crystalline polyester (also known as "amorphous polyester") resin.

The term "crystalline" in "crystalline polyester resin" as shown above signifies that, by differential scanning calorimetry (DSC), a distinct endothermic peak, and not a stepwise endothermic change, is discernible; more specifically, the endothermic peak measured at a heating rate of 10° C./min yields a half bandwidth within 15° C.

On the other hand, a resin yielding an endothermic peak with a half bandwidth exceeding 15° C. or a resin having no distinct endothermic peak signifies that it is non-crystalline (amorphous).

<Polycondensable Monomers for Producing Polyesters>

In the polyesters for use in the present invention, polyfunctional carboxylic acids usable as polycondensable monomers include compounds having two or more carboxyl groups within single molecule. Among them, dicarboxylic acid contains two carboxylic groups within one molecule, and examples include, for instance, oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, cyclohexanedicarboxylic acid, and the like. As polyfunctional carboxylic acids other than dicarboxylic acids, there can be mentioned, for example, trimellitic acid, pyromellitic acid, naphthalenetricarboxylic acid, naphthalenetetracarboxylic acid, pyrenetricarboxylic acid, pyrenetetracarboxylic acid, and the like. Furthermore, the carboxyl groups of these carboxylic acids may be induced to acid anhydrides, mixed acid anhydrides, acid chlorides, or esters, and the like, and used as above.

The polyols usable in the present invention are compounds having two or more hydroxyl groups in a single molecule. Among them, diols are compounds having two hydroxyl groups in a single molecule, and there can be mentioned examples such as ethylene glycol, propylene glycol, butanediol, diethylene glycol, hexanediol, cyclohexanediol, octanediol, decanediol, dodecanediol, and the like. As polyols other than diols, there can be mentioned, for example, glycerol, pentaerythritol, hexamethylolmelamine, hexaethylolmelamine, tetramethylolbenzoguanamine, tetraethylolbenzoguanamine, and the like.

The polyols above are sparingly soluble or insoluble to aqueous medium, andthe ester synthesis reaction proceeds inside monomer droplets in the polyol-dispersed aqueous medium.

Furthermore, the hydroxycarboxylic acids usable as polycondensable monomers in the present invention include hydroxyheptanoic acid, hydroxyoctanoic acid, hydroxydecanoic acid, hydroxyundecanoic acid, and the like.

The non-crystalline resins and crystalline resins can be easily obtained by as polycondensation resins for use in the present invention by combining the polycondensable monomers above.

(Crystalline Polyester)

As the polyfunctional carboxylic acids for use in obtaining crystalline polyesters, there can be mentioned from the carboxylic acids above; i.e., oxalic acid, malonic acid, succinic acid, glutaric acid, adipic acid, pimelic acid, spelic acid, azelaic acid, sebacic acid, maleic acid, fumaric acid, citraconic acid, itaconic acid, glutaric acid, n-dodecylsuccinic acid, n-dodecenylsuccinic acid, isododecylsuccinic acid, isododecenylsuccinic acid, n-octylsuccinic acid, and n-octenylsuccinic acid, as well as their acid anhydrides and acid chlorides.

As the polyols usable for obtaining the crystalline polyesters, mentioned as usable are ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexane glycol, 1,4-cyclohexane dimethanol, dipropyleneglycol, polyethylene glycol, polypropylene glycol, and the like.

As the crystalline polycondensed resins, there can be mentioned a polyester obtained by reacting 1,9-nonanediol with 1,10-decanedicarboxylic acid, or by reacting cyclohexanediol with adipic acid, a polyester obtained by reacting 1,6-hexanediol with sebacic acid, a polyester obtained by reacting ethylene glycol with succinic acid, a polyester obtained by reacting ethylene glycol with sebacic acid, and a polyester obtained by reacting 1,4-butanediol with succinic acid. Among them, particularly preferred are polyesters obtained by reacting 1,9-nonanediol with 1,10-decanedicarboxylic acid, or by reacting 1,6-hexanediol with sebacic acid.

(Non-Crystalline Polyester)

As the polyfunctional carboxylic acids for use in obtaining non-crystalline polyesters, there can be mentioned among polyfunctional carboxylic acids above, i.e., examples of dicarboxylic acids include, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid. As polyfunctional carboxylic acids other than dicarboxylic acids, there can be mentioned, for example, trimellitic acid, pyromellitic acid, naphthalenetricarboxylic acid, naphthalenetetracarboxylic acid, pyrenetricarboxylic acid, pyrenetetracarboxylic acid, and the like. Furthermore, the carboxyl groups of these carboxylic acids may be induced to acid anhydrides, mixed acid anhydrides, acid chlorides, or esters, and the like, and used as above.

Among them, preferably used are terephthalic acid and the lower esters thereof, diphenyl acetic acid, cyclohexanedicarboxylic acid, and the like. The "lower esters" as referred herein are esters of aliphatic alcohols having 1 to 8 carbon atoms.

As the polyols usable in the present invention for obtaining non-crystalline polyesters, preferably used among the polyols above are, particularly, polytetramethylene glycol, bisphenol A, bisphenol Z, hydrogenated bisphenol A, cyclohexanedimethanol, and the like.

Furthermore, non-crystalline resins and crystalline resins can be easily obtained by combining the polycondensable monomers above.

In order to prepare one type of polycondensed resin, one or more types each of the polyfunctional carboxylic acids and polyols above may be used; i.e., there may be combined one type each may be used singly, or one type from one and two or more types from the other, or two types or more of each may be used. Furthermore, in case hydroxycarboxylic acid is used to prepare one type of polycondensed resin, one type may be used singly, or two or more types may be used; it is also possible to combine polyfunctional carboxylic acids or polyols.

In the present invention, the polycondensation step may include a polymerization reaction in which the polyfunctional carboxylic acids and the polyols that are the polycondensation components are subjected to polymerization with a prepolymer prepared in advance. Any prepolymer capable of melting or uniformly mixing with the monomers above may be used without any limitations.

Further, the binder resin for use in the present invention may be a homopolymer of the polycondensation components above, a copolymer obtained by combining two or more types of monomers inclusive of the polymer components above, or a mixture, a graft polymer, a partly branched or crosslinked structure thereof.

<Characteristics of the Polyester Resin>

The crystal melting point Tm of the crystalline polyester resin is preferably in a range of from 50 to 120° C., and more preferably, in a range of from 55 to 90° C. Tm is preferably 50° C. or higher, because favorable cohesive force of the binder resin itself can be exhibited in the high temperature region to provide excellent peeling off properties and hot offset properties at fixing; Tm is preferably 120° C. or lower, because sufficient melting behavior can be obtained to avoid elevation of the minimum fixing temperature.

The melting point of the crystalline polyester resin can be obtained as the melting peak temperature, measured by using a differential scanning calorimeter (DSC) while heating from room temperature to 150° C. at a heating rate of 10° C. per minute according to the measurement by power compensation differential scanning calorimetry as described in JIS K-7121:87. A crystalline polyester resin may yield plural melting peaks, but in the present invention, the melting point is read on the maximum peak.

On the other hand, the glass transition temperature (Tg) of the non-crystalline polyester resin is preferably in a range of from 50 to 80° C., and more preferably, in a range of from 50 to 65° C. Tg is preferably 50° C. or higher, because favorable cohesive force of the binder resin itself can be exhibited in the high temperature region to provide excellent peeling off properties and hot offset properties at fixing; Tg is preferably 80° C. or lower, because sufficient melting behavior can be obtained to avoid elevation of the minimum fixing temperature.

In the present invention, weight average molecular weight of the crystalline polyester resin is ½ or lower than the weight average molecular weight of the non-crystalline polyester resin. If the weight average molecular weight of the crystalline polyester resin should exceed the weight average molecular weight of the non-crystalline polyester resin, the crystalline polyester resin becomes easily compatible with the non-crystalline polyester resin to generate filming, which makes improvement of the image quality unfeasible.

In other words, the weight average molecular weight of the non-crystalline polyester resin is twice or more greater than the weight average molecular weight of the crystalline polyester resin; preferably, the weight average molecular weight of the non-crystalline polyester resin is 2 to 10 times as large, and more preferably, is 2.1 to 5 times as large as that of the crystalline polyester resin.

The non-crystalline resin for use in the toner of the present invention preferably has a weight average molecular weight (Mw) of 5,000 to 100,000, as measured by molecular weight measurement of the tetrahydrofuran (THF) soluble component using gel permeation chromatography (GPC). More preferably, Mw is in a range of from 7,000 to 50,000, and the number average molecular weight (Mn) is preferably in a range of from 2,000 to 30,000; the molecular weight distribution Mw/Mn is preferably in a range of from 1.5 to 100, and more preferably, from 2 to 60.

The weight average molecular weight and the number average molecular weight in the range above are preferred, because they are effective for the low temperature fixing properties and provide favorable hot offset resistance, without lowering the glass transition temperature of the toner and free from affecting the blocking resistance and preservability of the toner. It is furthermore preferable because it does not affect storage properties of the document without preventing leaching out of the crystalline polyester phase that is present in the toner. Accordingly, the low temperature fixing properties and the hot offset resistance, as well as the document preservability can be acquired by satisfying the above preferred conditions.

In the present invention, the molecular weight of the resin is obtained by dissolving the resin in a THF solvent, measuring the THF-soluble component using TSK-GEL, GMH (product of TOSOH CORPORATION), and calculating the molecular weight in accordance with the molecular weight calibration curve prepared from monodisperse polystyrene standard sample.

In the present invention, the toner for developing electrostatic charge image contains the crystalline polyester resin and the non-crystalline polyester resin at a ratio of, preferably, 10:1 to 1:10, and more preferably, 5:1 to 1:5. Still preferably, the ratio is higher for the non-crystalline polyester resin, such as 1:2, 1:3, 1:4, and so on.

The content ratio of the crystalline polyester resin and the non-crystalline polyester resin in the range above is preferred because the image quality can be favorably maintained under high temperature and high humidity conditions.

[Polymerization of Polyester Resin (Polycondensation)]

In the present invention, the crystalline polyester resin and/or the non-crystalline polyester resin were/was polymerized at temperatures not higher than 150° C. while using a Bronsted acid containing sulfur atom as a catalyst. The production energy of the toner cannot be lowered if the crystalline polyester resin and the non-crystalline polyester resin are not polymers obtained by polymerization using a Bronsted acid containing sulfur atom as a catalyst and at temperatures not higher than 150° C. while.

The crystalline and the non-crystalline polyester resins can be produced in accordance with a known method by polycondensation reaction of the aforementioned polyhydric alcohols and polyfunctional carboxylic acids. The polycondensation reaction can be effected by common polycondensation methods such as bulk polymerization, emulsion polymerization, polymerization in water such as suspension polymerization and the like, solution polymerization, interfacial polymerization, and the like, but preferred among them is bulk polymerization. Furthermore, although it is possible to carry out the reaction under atmospheric pressures, commonly known conditions such as reduced pressure, under flow of gaseous nitrogen, and the like, can be employed in order to accomplish objectives such as obtaining polyester molecules with higher molecular weight, and the like.

More specifically, the production can be carried out by feeding the polyhydric alcohol and polycarboxylic acid above together with a catalyst, if necessary, inside a reaction vessel equipped with a thermometer, a stirrer, a flow-down condenser; heating them in the presence of an inert gas (for instance, gaseous nitrogen and the like) while continuously removing the low molecular weight compound by-product from the reaction system; and stopping the reaction at the time the desired acid number is achieved, thereby obtaining the desired reaction product by cooling.

As described above, at least one of the crystalline polyester resins and the non-crystalline polyester resins is such obtained by polymerization at 150° C. in the presence of a Bronsted acid catalyst containing sulfur atom.

<Catalyst>

(Bronsted Acid Catalyst Containing Sulfur)

As a Bronsted acid catalyst containing sulfur, usable but not limited to are, for instance, alkylbenzenesulfonic acid, such as dodecylbenzenesulfonic acid, isopropylbenzenesulfonic acid, camphorsulfonic acid, and the like; higher fatty acid sulfate esters, such as of alkylsulfonic acid, alkyldisulfonic acid, alkylphenolsulfonic acid, alkylnaphthalenesulfonic acid, alkyltetralinsulfonic acid, alkylallylsulfonic acid, petroleumsulfonic acid, alkylbenzoimidazolesulfonic acid, higher alcohol ether sulfonic acid, alkyldiphenylsulfonic acid, monobutylphenylphenolsulfuric acid, dibutylphenylphenolsulfuric acid, dodecyl sulfuric acid, sulfate ester, and the like; higher alcohol sulfate ester, higher alcohol ether sulfate ester, higher fatty acid amidoalkylol sulfate ester, higher fatty acid amidoalkylated sulfate ester, naphthenyl alcohol sulfate, sulfated fat, sulfosuccinate ester, sulfonated higher fatty acid, resin acid alcohol sulfate, as well as the salts of the compounds enumerated above. Furthermore, these catalysts may contain functional groups in the structure. If necessary, plural catalysts above may be combined. Mentioned as preferable Bronsted acids containing sulfur atom are, for instance, dodecylbenzenesulfonic acid, benzenesulfonic acid, p-toluenesulfonic acid, camphorsulfonic acid, and the like.

Other generally used polycondensation catalysts may be used together with the catalysts above. Specific examples include metallic catalysts, hydrolytic enzyme type catalysts, basic catalysts, Bronsted acid catalysts free of sulfur, and the like.

(Metallic Catalysts)

Examples of non-limiting metallic catalysts include, for instance, organotin compounds, organotitanium compounds, organohalogenated tin compounds, rare earth metallic catalysts, and the like.

Effective as the catalysts containing rare earth metals are, specifically, scandium (Sc), yttrium (Y), lanthanoid elements such as lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), lutetium (Lu), and the like. These are particularly effective when used as alkylbenzenesulfonate salts, alkylsulfate esters, triflate structures, and the like. An example of such triflates can be shown by the structural formula $X(OSO_2CF_3)_3$, where X represents a rare earth metal element, and particularly preferred as X are scandium (Sc), yttrium (Y), ytterbium (Yb), samarium (Sm), and the like.

Details on lanthanoid triflates can be found in Journal of Synthetic Organic Chemistry, Japan, Vol. 53, No. 5, pp 44-54.

In case a metallic catalyst is used as the catalyst, the concentration of the metal originated from the catalyst is 100 ppm or lower in the resin product. More preferably, the concentration is 75 ppm or lower, and most preferably, 50 ppm or lower. Accordingly, preferably, no metallic catalyst is used, or if used, the usage is preferably as low as possible.

(Hydrolytic Enzyme Type Catalysts)

Any type of hydrolytic enzyme type catalysts capable of functioning as a catalyst for ester synthetic reaction may be used with no limitations. Hydrolytic enzyme type catalysts for use in the present invention include, for instance, esterase classified in EC (enzyme number) Group 3.1 (See, for example, Maruo and Tamiya, Ed., "Enzyme Handbook", Asakura Shoten (1982)) carboxyesterase, lipase, phospholipase, acetylesterase, pectinesterase, cholesterolesterase, tannase, monoacylglycerollipase, lactonase, and lipoproteinlipase; the hydrolase which functions on glycosyl compounds classified in EC Group 3.2, such as glucoxidase, garactoxidase, glucuronidase, and xylodase; hydrolase classified in EC Group 3.3, such as epoxyde hydrase, and the like; hydrolase which functions on peptide bonds as classified in EC Group 3.4, such as aminopeptidase, quimotrypsin, trypsin, plasmin, subtilisin, and the like; hydrolase classified in EC Group 3.7, such as florentine hydrase; and so on.

Among the esterase above, particularly, enzymes capable of producing free fatty acid through hydrolysis of glycerol esters are known as lipase. Lipases are highly stable in an organic solvent, function as a high yield catalyst in ester synthesis reaction, and are advantageous in that they can be acquired at low cost. Likewise, it is preferred to use lipase in the present invention from the viewpoint of yield and cost.

Lipases of various origins can be used, but preferred are to use lipase obtained from microorganisms belonging to, for example, *Pseudomonas, Alcaligenes, Achromobacter, Candida, Aspergillus, Rhizopus, Mucor*, and the like; lipase from plant seeds; lipase acquired from animal tissues; as well as pancreatin, steapsin, and the like. Among them, preferred is to use lipase originated from microorganisms, such as *Pseudomonas, Candida*, and *Aspergillus*.

(Basic Catalyst)

As basic catalysts, there can be mentioned generally used organic basic compounds, nitrogen-containing basic compounds, and tetraalkyl or arylphosphonium hydroxide such as tetrabutylphosphonium hydroxide, but the invention is not limited thereto. As organic basic compounds, examples include ammonium hydroxides such as tetramethylammonium hydroxide, tetraethylammonium hydroxide, and the like; nitrogen-containing basic compounds include amines, such as triethylamine, dibenzylmethylamine, and so on, or pyridine, methoxypyridine, quinoline, imidazole, and the like; hydroxides of alkali metals such as sodium, potassium, lithium, cesium, and the like; or of alkaline earth metals such as calcium, magnesium, barium, and the like; hydrides and amides; salts of acids with alkali and alkaline earth metals, such as carbonates, borates, and carboxylates; or salts with phenolic hydroxyl groups.

There also can be mentioned compounds with alcoholic hydroxyl groups, chelate compounds of acetylacetone, and the like, but the invention is not only limited thereto.

(Bronsted Acid Catalyst Free of Sulfur)

Examples of Bronsted acid catalysts free of sulfur include various types of fatty acids, higher alkylphosphate esters, resin acid, naphthenic acid, and niobic acid, but are not limited thereto.

The total amount of added catalyst is in a range of, preferably, from 0.01 to 10% by weight, and more preferably, from 0.01 to 8% by weight, with respect to the polycondensation components. One type of catalyst may be used singly, or two or more types may be used in combination.

<Reaction Temperature>

In the present invention, the polycondensation of the crystalline polyester resin and/or non-crystalline polyester resin is performed at a temperature of 150° C. or lower.

The reaction temperature is preferably 70° C. or higher but not higher than 150° C., and more preferably, 80° C. or higher but not higher than 140° C.

Preferably, the reaction temperature is set to 70° C. or higher, because a decrease in reactivity ascribed to the deterioration of monomer solubility or catalyst activity does not occur, and the molecular weight increases without being suppressed. Also preferably, the reaction temperature is set to not higher than 150° C., because this enables production at low energy. Further preferably, there is no coloring of the resin or no decomposition occurs on the produced polyester and the like.

[Toner for Developing Electrostatic Charge Image]

In the present invention, the toner for developing electrostatic charge image contains a crystalline polyester resin, a non-crystalline polyester resin, and a releasing agent; if necessary, other components such as colorants and the like are added.

<Toner Characteristics>

(First Onset Temperature)

In the present invention, the first onset temperature, A(° C.), of the toner as measured by differential scanning calorimeter (DSC) and the glass transition temperature, B(° C.), of the non-crystalline polyester resin satisfy the relation $(B-A) \leqq 10$. That is, the first onset temperature of the toner falls within −10° C. from the glass transition temperature of the non-crystalline polyester resin.

Preferably, the relation $(B-A) \leqq 8$ is satisfied, and more preferably, $(B-A) \leqq 5$ is satisfied.

The first onset temperature of the toner as measured by DSC is obtained by carrying out measurements in accordance with ASTM D3418, by using a differential scanning calorimeter provided with an automatic tangential processing system, i.e., DSC-50, manufactured by Shimadzu Corporation. The measuring conditions are as follows:

Sample mass: 3 to 15 mg, preferably, 5 to 10 mg.

Method of measurement: The sample is placed inside an aluminum pan, and an empty aluminum pan is used as a reference.

Temperature profile: Heating I (from 20 to 180° C., at a heating rate of 10° C./min).

The first onset temperature is acquired from the endothermic peak obtained according to Heating I of the temperature profile. The first onset temperature as referred herein is obtained by drawing a tangential line drawn at the lowest temperature of the temperatures at which the differential values of the endothermic peak curves yield local maxima, and then reading the temperature at which the tangential line of the curve crosses the baseline. That is, in case there are plural endothermic peaks, the onset temperature of the endothermic peak located at the lowest melting point side is regarded as the first onset temperature.

The first onset temperature of the toner is preferably 50° C. or higher, and more preferably, 52° C. or higher.

A first onset temperature of 50° C. or higher is preferred, because in such a case, the toner possesses a favorable glass transition temperature and the generation of filming is reduced.

(Maximum Temperature of Melting Endothermic Peak of Releasing Agent for the Toner)

The maximum melting endothermic peak of releasing agent for the toner is preferably in a temperature range of 70 to 90° C., and more preferably, in a range of 70 to 85° C. If the maximum melting endothermic peak of releasing agent for the toner is in the aforementioned range, favorable peeling off properties from hot rollers and belts in the fixing machine can be achieved and is therefore preferred.

The maximum melting endothermic peak of releasing agent is the temperature which provides the maximum endothermic peak in case the endothermic curve is obtained for the toner using the differential scanning calorimeter (DSC) according to Heating I under the conditions above.

(Average Equivalent Volumetric Particle Diameter)

The toner according to the present invention preferably has an average equivalent volumetric particle diameter ($D_{50}$) in a range of from 3.0 μm to 20.0 μm. More preferred is the case in which the average equivalent volumetric particle diameter is in a range of from 3.0 μm to 9.0 μm. A $D_{50}$ of 3.0 μm or larger is preferred, because favorable adhesive force can be obtained and no decrease occurs in developing properties. Further, a $D_{50}$ of 9.0 μm or smaller is preferred, because sufficiently high image resolution can be obtained. The average equivalent volumetric particle diameter ($D_{50}$) can be measured by using a laser diffraction particle size distribution measuring apparatus and the like.

(Average Volume Average Particle Size Distribution)

Further, the toner of the present invention preferably yields geometric standard deviation based on volume GSDv of 1.4 or lower. In case of chemically produced toners, in particular, more preferred is that they yield a GSDv of 1.3 or lower.

To obtain GSDv, particle size ranges (channels) are divided based on the particle size distribution, and volume equivalent cumulative distribution is produced from the smaller particle diameter side to define the particle diameter corresponding to 16% cumulative as volume and the particle diameter corresponding to 84% cumulative as volume $D_{84v}$. The geometric standard deviation based on volume (GSDv) is calculated according to the following equation:

Geometric standard deviation based on volume, $$GSDv=(D_{84v}/D_{16v})^{0.5}$$

A GSDv of 1.4 or lower is preferred, because, the particle diameter becomes uniform to yield favorable fixing properties, while preventing causing machine failure attributed to inferior fixing. Moreover, it is also preferred because inner contamination due to the scattering of toners or degradation of developers can be prevented from occurring.

The geometric standard deviation based on volume GSDv can be obtained by using a laser diffraction particle size distribution measuring apparatus and the like.

(Shape Factor)

In case the toner according to the present invention is produced by a chemical process, the shape factor SF1 is preferably in a range of 100 to 140, more preferably, 110 to 135, from the viewpoint of image forming properties. In this case, SF1 is calculated according to the equation below:

$$SF1 = \frac{(ML)^2}{A} \times \frac{\pi}{4} \times 100$$

where, ML represents the maximum absolute length of the particle, and A represents the projected area of the particle.

These values are mainly obtained by taking the microscope images or scanning electron microscope images into a LUZEX image analyzer, and analyzing the images and converting them into numerical values.

[Method for Producing Toner for Developing Electrostatic Charge Image]

The method for producing toner for developing electrostatic charge image according to the present invention comprises at least a step of aggregating in an aqueous medium, particles containing at least a crystalline polyester resin (sometimes referred to hereinafter as "crystalline polyester resin particles"), particles containing non-crystalline polyester resin (sometimes referred to hereinafter as "non-crystalline polyester resin particles") and particles of a releasing agent (this step is sometimes referred to hereinafter as "aggregation step"); and a step of heating the aggregated particles to fuse into a coalescent body (this step is sometimes referred to hereinafter as "fusion coalescence step").

In the method for producing the toner for developing electrostatic charge image according to the present invention, if necessary, particles containing colorant particles (if the colorant is added into the resin beforehand during the aforementioned polycondensation step and the like, the particles themselves are the colored particles), other resin particles, or a dispersion of such particles and the like, may be added into an aqueous medium (dispersion) having dispersed therein at least crystalline polyester resin particles, non-crystalline resin particles, and the releasing agent particles. According to the method for producing the toner for developing electrostatic charge image, it is possible to control the toner particle diameter and the particle size distribution of the toner particles by aggregating (coalescing) the crystalline polyester resin particles, non-crystalline polyester resin particles, releasing agent particles and other added particles in the dispersion above using known aggregation method. In further detail, the dispersion of the crystalline polyester resin particles and the dispersion of non-crystalline polyester resin particles are mixed with the colorant particles dispersion, a dispersion containing releasing agent particles, and the like; aggregated particles having a toner diameter are formed by adding a flocculant to cause hetero aggregation; and the aggregated particles are heated to a temperature not lower than the glass transition temperature or the melting point to melt and coalesce the aggregate particles, which is then rinsed and dried to obtain the final product. The production method enables controlling the toner particle shape from amorphous to spherical by changing the heating temperature conditions.

<Preparation of Dispersion>

(Preparation of Polyester Resin Particles Dispersion)

There are no particular limitations concerning the method for dispersing the crystalline polyester resin and the non-crystalline polyester resin produced in the aforementioned manner. Any one can be selected from known methods such as forced emulsification method, spontaneous emulsification method, phase inversion emulsification method, and the like. Among them, by taking into consideration of the energy necessary for the emulsification, the controllability of particle diameter of the emulsified product, stability, and the like, spontaneous emulsification method and phase inversion emulsification method are favorably applied.

The self emulsification method and phase conversion emulsification method are described in "Application technology of superfine polymer particles" (CMC Publishing CO., LTD). The polar groups usable in self emulsification include a carboxyl group, a sulfonate group, and the like, but carboxyl group is preferred for application to a non-crystalline polyester binder resin for toners.

A dispersion of crystalline polyester resin particles and a dispersion of non-crystalline polyester resin particles may be separately prepared and mixed, or a dispersion having dispersed therein the crystalline polyester resin particles and the non-crystalline polyester resin particles may be prepared in advance.

The average weight equivalent particle diameter of the particles containing crystalline polyester resin is preferably 1 μm or less, and more preferably, from 100 to 600 nm, and further preferably, from 150 to 400 nm.

Setting the average weight equivalent particle diameter in the range above is preferred because the particle diameter of the aggregated particles can be easily controlled.

(Preparation of Dispersion of Releasing Agent Particles)

Examples of the releasing agents include low molecular weight polyolefins such as polyethylene, polypropylene, polybutene, and the like; silicones which yield a softening point; fatty acid amides such as oleic amide, erucic amide, ricinoleic amide, stearic amide, and the like; plant wax such as ester wax, carnauba wax, rice wax, canderilla wax, wood wax, jojoba oil, and the like; animal wax such as bees wax; mineral or petroleum based wax such as montan wax, ozokerite, ceresin wax, paraffin wax, microcrystalline wax, Fisher-Tropsch wax, and so forth; the denaturated products thereof can be used as well.

The melting point of the releasing agent is preferably 60° C. or higher, more preferably, 65° C. or higher, and furthermore preferably, 70° C. or higher. Releasing agents having their melting points in the range above are preferred because fluidity of the toner and the filming to photoreceptor can be suppressed.

The waxes above are dispersed in water together with ionic surfactants, polymer electrolytes such as polymer acids and polymer bases, and are finely divided by using a homogenizer or a pressure-discharge disperser capable of applying strong shearing force while heating to melting point or higher. In this manner, a dispersion of particles 1 μm or smaller in size can be prepared.

The average weight equivalent particle diameter of the releasing agent particles in aqueous medium is preferably 1 μm or smaller, more preferably, from 100 to 700 nm, and still more preferably, 100 to 500 nm. It is preferred to set the average weight equivalent particle diameter of the releasing agent particles in the range above, because the particle diameter of the aggregated particle can be easily controlled and favorable effects as releasing agent can be obtained.

In the present invention, preferably in the aqueous medium, the average weight equivalent particle diameters of the crystalline polyester resin particles and the releasing agent particles are larger than the average weight equivalent particle diameter of the non-crystal line resin particles. It is preferred to make the average weight equivalent particle diameter of the crystalline polyester resin particles and the releasing agent particles greater than the average weight equivalent particle diameter of the non-crystalline resin particles in aqueous medium, because it is possible to suppress not only the compatibility among the individual particles on melting and coalescing the aggregated particles for toner production, but also the generation of filming on photoreceptor.

The average weight equivalent particle diameter of the crystalline polyester resin particles and the releasing agent particles in aqueous medium is preferably 1.1 to 3 times, more preferably, 1.1 to 2.5 times, as large as the average weight equivalent particle diameter of the non-crystalline polyester resin particles.

<Aggregation Step>

In the aforementioned aggregation step of the present invention, it is possible to mix a dispersion of resin particles other than the dispersion of crystalline polyester resin particles or the dispersion of non-crystalline polyester resin particles, and then carrying out the steps sequent to the aggregation step. In such a case, for example, the dispersion of crystalline polyester resin particles and/or the dispersion of non-crystalline polyester resin particles are/is aggregated in advance to form the first aggregated particles, and then, a dispersion of crystalline polyester resin particles, a dispersion of non-crystalline polyester resin particles, or a dispersion of other resin particles is/are added to form a second shell layer on the surface of the first aggregated particles, thereby implementing multilayered particles. As a matter of course, the process of the example above can be reversed to form the multilayered particles.

(Flocculants)

Favorably used as the flocculants are, in addition to surfactants, inorganic salts and salts of divalent or higher metals. In particular, the case of using metallic salts is preferred from the viewpoint of material characteristics such as aggregation control, toner chargeability, and the like. Metallic salt compounds for use as flocculants can be obtained by dissolving common inorganic metal compounds or their polymers in the resin particle dispersion; the metal elements constituting the inorganic metal salts may be any of those having divalent or higher charge and belonging to Group 2A, 3A, 4A, 5A, 6A, 7A, 8, 1B, 2B, and 3B of the periodic table (long form periodic table), and which may dissolve in the form of ions into the aggregation system of resin particles. Specific examples of preferred inorganic metal salts include metallic salts such as calcium chloride, calcium nitrate, barium chloride, magnesium chloride, zinc chloride, aluminum chloride, aluminum sulfate, and so forth; as well as inorganic metallic salt polymers such as polyaluminum chloride, polyaluminum hydroxide, calcium polysulfide, and the like. Particularly preferred among them are the aluminum salts and the polymers thereof. In order to obtain a sharper particle size distribution, in general, divalent is better than monovalent, and trivalent or higher is better than divalent. Furthermore, if the valence should be the same, polymerized type inorganic metal salt polymers are better suited.

(Dispersion of Addition Polymerization Type Resin Particles)

It is also possible to mix, in addition to the dispersion of crystalline polyester resin particles or the dispersion of non-crystalline polyester resin particles, a dispersion of addition polymerization type resin particles prepared by a known emulsion polymerization. The resin particles contained in the dispersion of addition polymerization type resin particles preferably has a median diameter similar to that of the resin particle dispersion according to the present invention, i.e., 0.02 μm or larger but not larger than 2.0 μm.

In order to prepare the dispersion of addition polymerization type resin particles, examples of the monomers for use in the addition polymerization system include styrenes such as styrene, p-chlorosytrene, and the like; vinyl esters such as vinylnaphthalene, vinyl chloride, vinyl bromide, vinyl fluoride, vinyl acetate, vinyl propionate, vinyl benzoate, vinyl butyrate, and the like; methylene aliphatic carboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, butyl methacrylate, and the like; acrylonitrile, methacrylonitrile, acrylamide, vinyl ethers such as vinyl methyl ether, vinyl ethyl ether, vinyl isobutyl ether, and the like; monomers having N-containing polar groups such as N-vinyl compounds inclusive of N-vinylpyrrole, N-vinylcarbazole, N-vinylindole, N-vinylpyrrolidone, and so forth; as well as vinyl based monomers, i.e., vinylcarboxylic acids such as methacrylic acid, acrylic acid, cinnamic acid, carboxyethyl acrylate, and the like; which may be used as homopolymers or copolymers, or in combination with various types of waxes.

In the case of monomers for addition polymerization system, resin particle dispersion can be prepared by carrying out emulsion polymerization using an ionic surfactant and the like; in the case of other resins, if they are oily and soluble to solvent having relatively low solubility to water, the resins are dissolved in such solvents and then dispersed as particles by using an ionic surfactant or a polymer electrolyte and applying a disperser such as a homogenizer, from which the solvent is evaporated off by heating or reducing pressure to thereby obtain the resin particle dispersion.

Furthermore, a polymerization initiator or a chain transfer agent may be used on polymerizing the monomers for addition polymerization system.

As the polymerization initiators, known polymerization initiators may be used; specifically mentioned are, for example, ammonium persulfate, potassium persulfate, sodium persulfate, 2,2'-azobis(2-methylpropionamido)dihydrochloride, t-butylperoxy-2-ethylhexanoate, cumyl perpyvalate, t-butylperoxylaurate, benzoyl peroxide, lauroyl peroxide, octanoylperoxide, di-t-butylperoxide, t-butylcumyl peroxide, dicumyl peroxide, 2,2'-azobisisobutyronitrile, 2,2'-azobis(2-methylbutylnitrile), 2,2'-azobis(2,4-dimethylvaleronitrile), 2,2'-azobis(4-methoxy-2,4-dimethylvaleronitrile), 1,1-bis-(t-butylperoxy)-3,3,5-trimethylcyclohexane, 1,1-bis-(t-butylperoxy)cyclohexane, 1,4-bis-(t-butylperoxycarbonyl)cyclohexane, 2,2-bis-(t-butylperoxy)octane, n-butyl-4,4-bis-(t-butylperoxyisopropyl)varylate, 2,2-bis-(t-butylperoxy)butane, 1,3-bis-(t-butylperoxyisopropyl) benzene, 2,5-dimethyl-2,5-di(t-butylperoxy)hexane, 2,5-dimethyl-2,5-di(benzoylperoxy)hexane, di-t-butyldiperoxyisophthalate, 2,2-bis(4,4-di-t-butylperoxycyclohexyl)propane, di-t-butylperoxy α-methylsuccinate, di-t-butylperoxy dimethylglutarate, di-t-butylperoxy hexahydroterephthalate, di-t-butylperoxyazelate, 2,5-dimethyl-2,5-di-(t-butylperoxy)hexane, diethylene glycol-bis(tbutylperoxycarbonate), di-t-butylperoxytrimethylazipate, tris(t-butylperoxy)triazine, vinyl-tris(t-butylperoxy)silane, 2,2'-azobis(2-methylpropionamidinedihydrochloride), 2,2'-azobis [N-(2-carboxyethyl)-2-methylpropionamidine], 4,4'-azobis(4-cyanovaleric acid), and the like.

Chain transfer agents may be used without particular limitations. Specifically preferred are those having covalent bond with carbon and sulfur atoms, and mentioned are, preferably, thiols.

In the present invention, if necessary, known additives may be blended either singly or as a combination of plural types so long as they have no influence on the results of the present invention. For example, there may be added fire retardants, auxiliary fire retardants, brightners, waterproofing agents, water repellants, magnetic bodies, inorganic fillers (surface modifiers), antioxidants, plasticizers, surfactants, dispersants, lubricants, fillers, pigments, binders, charge controllers, and the like. These additives may be blended at any time the coating agent is produced.

In preparing the toner according to the present invention, components generally necessary for toners, such as colorants, fixing aids such as waxes, other charge aids, and so forth, may be added previously into the aqueous medium to carry out the polycondensation of the polycondensed resin particles in the aqueous medium, such that they may be blended into the polycondensed resin particles simultaneously with the polycondensation.

(Colorants)

Examples of the colorants usable in the present invention are, for instance, those enumerated below.

As black color pigments, mentioned are carbon black, copper oxide, manganese dioxide, aniline black, active carbon, non-magnetic ferrite, magnetite, and the like.

As yellow color pigments, there can be mentioned chrome yellow, zinc chromate, yellow color iron oxide, cadmium yellow, Chrome Yellow, Hansa Yellow, Hansa Yellow 10G, Benzidine Yellow G, Benzidine Yellow GR, Threne Yellow, quinoline yellow, permanent yellow NCG, and the like.

As orange pigments, included are chrome orange, molybdenum orange, Permanent Orange GTR, pyrazolone orange, Vulcan Orange, Benzidine Orange G, Indathrene Brilliant Orange RK, Indathrene Brilliant Orange GK, and the like.

As red pigments, there can be mentioned iron red, cadmium red, minium, mercury sulfide, Watchyoung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eoxine Red, Alizarin Lake, and the like.

As blue pigments, there can be mentioned Prussian Blue, cobalt blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green, Malachite Green Oxalate, and the like.

As violet pigments, there can be mentioned manganese violet, Fast Violet B, Methyl Violet Lake, and the like.

As green pigments, mentioned are chromium oxide, chromium green, Pigment Green, Malachite Green Lake, Final Yellow Green G, and the like.

As white pigments, mentioned are zinc white, titanium oxide, antimony white, zinc sulfide, and the like.

As body pigments, mentioned are barite powder, barium carbonate, clay, silica, white carbon, talc, white alumina, and the like.

Furthermore, as dyes, there can be mentioned various kinds of dyes, such as basic, acidic, dispersion, and direct dyes, for instance, nigrosine, Methylene Blue, Rose Bengal, Quinoline Yellow, Ultramarine Blue, and the like.

These colorants are used solely or as a mixture. A dispersion of colorant particles can be prepared by using arbitrary methods, for example, generally known methods using a rotary shear-type homogenizer, a media dispersing apparatus using media, such as a ball mill, a sand mill, an attritor, and so forth, a high pressure counter collision dispersing apparatus and the like, a Dyno Mill, and the like.

Furthermore, the colorant can be dispersed in an aqueous system with a homogenizer by using a surfactant having polarity; otherwise, it may be added into the mixed solvent at one time with other fine particle components, or may be added separately in several times.

The colorant used in the invention is selected from the standpoint of hue angle, chroma saturation, brightness, weather resistance, OHP transparency and dispersibility in the toner.

The colorant can be added in an amount of from 4 to 15% by weight based on the weight of the total solid content of the toner.

In case a magnetic material is used as a black colorant, it can be added in an amount of from 12 to 240% by weight, which is different from the other colorants.

The mixing amount of the colorant above is requisite for assuring coloration properties upon fixing. In case the colorant particles in the toner have a central diameter (median diameter) in a range of from 100 to 330 nm, the OHP transparency and the coloration properties are assured.

The central diameter of the colorant particles was measured, for example, by a laser diffraction particle size distribution analyzer (LA-920, manufactured by Horiba, Ltd.).

As the magnetic bodies, specifically, a substance that can be magnetized in a magnetic field is used, and examples thereof include ferromagnetic powder, such as of iron, cobalt, nickel, and so forth, as well as compounds such as ferrite, magnetite, and the like.

In case the toner of the invention is obtained in an aqueous medium, it is necessary to pay attention to aqueous phase migration properties of the magnetic material, and it is preferred that the surface of the magnetic material is modified in advance, for example, subjected to a hydrophobic treatment.

As a charge controlling agent, various kinds of charge controlling agents that are ordinarily employed can be used, such as a quaternary ammonium salt compound, a nigrosine compound, a dye containing a complex of aluminum, iron, chromium, and the like, a triphenylmethane pigment, and so forth. Those materials that are sparingly soluble in water are preferred from the standpoint of controlling the ion strength which influences the stability upon aggregation and coalescence, and of reducing wastewater pollution.

Examples of the surfactant used in polycondensation, dispersion of a pigment, production and dispersion of resin particles, dispersion of a releasing agent, aggregation, stabilization of these operations, and the like, include anionic surfactants such as sulfate ester salts, sulfonate salts, phosphate esters, soaps, and so forth; cationic surfactants such as amine salt types, quaternary ammonium salt types, and the like; it is effective to simultaneously use in combination a nonionic surfactant, such as polyethylene glycols, alkylphenol ethylene oxide adducts, polyhydric alcohols, and the like. Examples of the means for dispersion include using generally employed apparatuses, including a rotation shear-type homogenizer, and those using media, such as a ball mill, a sand mill, Dyno Mill, and the like.

For fire retardants and auxiliary fire retardants, examples include the commonly used bromine-based fire retardant, antimony trioxide, magnesium hydroxide, aluminum hydroxide, and ammonium polyphosphate, but are not limited thereto.

<Fusion Coalescence Step>

In the fusion coalescence step, the particles aggregated in the aggregation step (aggregated particles) are heated to a temperature not lower than the melting point of the crystalline polyester resin or the glass transition temperature of the non-crystalline polyester resin to fuse and allow coalescence the aggregated particles.

In this case, where the releasing agent particles have a melting point of C(° C.), it is preferred that the temperature for fusion coalescence is set to (C+10) (° C.) or lower, and more preferably, (C+8) (° C.) or lower.

If the heating temperature is in the above range, the compatibility among the aggregated particles can be controlled, and is therefore preferred.

In order to obtain the desired toner, it is also preferred to control the cooling step after completing the fusion coalescence step. In the present invention, preferably, the fusion coalesced toner particles are cooled gradually. It is preferred because the compatibility among the aggregated particles can be controlled by gradual cooling.

More specifically, for instance, there can be exemplified cooling from the fusion coalescence step, by once holding at 30 to 60° C. for 0.2 to 20 hours. More preferably, temperature is held at 40 to 55° C., and still more preferably, at 40 to 50° C. The retention time is preferably 0.5 to 10 hours, and more preferably, 1 to 5 hours.

Upon completion of the fusion coalescence step, the desired toner particles are obtained through arbitrarily set rinsing step, solid-liquid separation step, and drying step. Concerning charging properties, the rinsing step is preferably carried out by thorough substitution washing with ion exchanged water. There are no particular limitations on solid-liquid separating step, and suction filtration, pressured filtration, and the like, are preferred from the standpoint of productivity. The drying step also has no particular limitations, and freeze drying, flash jet drying, fluidized drying, vibrating fluidized drying, and the like are preferably employed from the standpoint of productivity.

With the purpose of imparting fluidity, improving cleaning properties and the like, the toner according to the present invention preferably contains inorganic particles, either mixed or added on the surface of the resin particles.

The inorganic particles usable in the present invention preferably have a primary particle diameter in the range of from 5 nm to 2 μm, and more preferably, from 5 nm to 500 nm. The specific surface area as measured in accordance with BET method is preferably in a range of 20 to 500 $m^2/g$. The amount mixed in the toner is 0.01 to 5% by weight, and preferably, 0.01 to 2.0% by weight.

As the inorganic particles, there can be mentioned silica powder, alumina, titanium oxide, barium titanate, magnesium titanate, calcium titanate, strontium titanate, zinc oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, silicon nitride, and the like; particularly preferred among them is silica powder.

The silica powder as referred herein is a powder having Si—O—Si bonding, and includes both of the powders prepared by dry and wet methods. In addition to anhydrous silicon dioxide, usable are any of aluminum silicate, sodium silicate, potassium silicate, magnesium silicate, zinc silicate, and the like, but preferred are those containing 85% by weight or more of $SiO_2$.

Specific examples of the silica powder above include various types of commercially available silica, and those having hydrophobic groups on the surface are preferred, for instance, AEROSIL R-972, R-974, R-805, R-812 (products of NIPPON AEROSIL Co., LTD.), Talux500 (Tarco, Co. Ltd.), and the like. Also usable are silica powder treated with a silane coupling agent, titanium coupling agent, silicone oil, silicone oil having amine side chains, and the like.

Examples of the surfactant used in the production step of the toner for developing elec. of the present invention include anionic surfactants such as sulfate ester salts, sulfonate salts, phosphate esters, soaps, and so forth; cationic surfactants such as amine salt types, quaternary ammonium salt types, and the like; it is effective to simultaneously use in combination a nonionic surfactant, such as polyethylene glycols, alkylphenol ethylene oxide adducts, polyhydric alcohols, and the like. Examples of the means for dispersion include using generally employed apparatuses, including a rotation shear-type homogenizer, and those using media, such as a ball mill, a sand mill, Dyno Mill, and the like.

[Electrostatic Charge Image Developer]

The toner for developing electrostatic charge image according to the present invention is used as an electrostatic charge image developer. There are no particular limitations for the toner for developing electrostatic charge image, so long as the developer contains the toner for developing electrostatic charge image, and the components and composition can be properly selected depending on the purpose. If the toner for developing elec. is used solely, a one-component electrostatic charge image developer is prepared, and it is combined with a carrier, a two-component electrostatic charge image developer can be obtained.

The carrier is not specifically limited, and there can be mentioned conventionally known carriers, such as magnetic particles, for example, iron powder, ferrite, iron oxide powder, nickel, and the like; resin-coated carriers having a resin coating layer formed by covering with a resin such as styrene resin, vinyl resin, ethylene resin, rosin resin, polyester resin, melamine resin, and so forth, or a wax such as stearic acid, and so forth; and magnetic particle dispersed carriers comprising magnetic particles dispersed in a binder resin. The resin-coated carriers are preferred among them, because the toner chargeability and the resistance of the entire carrier can be controlled by the constitution of the resin coating layer.

The mixing ratio of the toner and the carrier in a two-component system electrostatic charge image developer according to the present invention is, in general, 2 to 10 parts by weight of toner with respect to 100 parts by weight of carrier. The toner may be prepared by any method without any limitations, and there can be mentioned a method comprising mixing with a V-blender.

[Method of Forming Image]

The toner for developing electrostatic charge image and the developer for developing electrostatic charge image according to the present invention can be used in processes for forming images according to an ordinary electrostatic charge image developing method (electrophotographic method).

The method for forming an image according to the present invention comprises a latent image forming step for forming electrostatic latent image on the surface of a latent image retaining body, a development step comprising forming a toner image by developing the electrostatic latent image formed on the surface of said latent image retaining body by using a toner or an electrostatic charge image developer, a step of transferring the toner image formed on the surface of said latent image retaining body to the surface of the image transfer body, and a fixing step comprising thermally fixing the toner image transferred to the surface of the image transfer body; which is characterized in that it uses the toner for developing electrostatic charge image of the present invention as the toner or the electrostatic charge image developer of the present invention as the developer.

Each of the steps above can be carried out according to the steps of known methods for forming images as described in, for instance, JP-A-56-40868, JP-A-56-91231, and the like. Furthermore, the method for forming image according to the present invention may include steps other than those described above, for instance, preferably mentioned is a cleaning step for removing the electrostatic charge image developer remaining on the electrostatic latent image carrier. A further preferred embodiment of the method for forming image according to the present invention is such comprising a recycling step. In the recycling step, the toner for developing the electrostatic charge image recovered in the cleaning step is transferred to the developer layer. This embodiment of the method for forming an image comprising the recycling step can be realized by using image forming apparatuses such as the copiers, facsimiles, and the like, of toner recycle system types. Furthermore, this can be applied to a recycle system of another embodiment, in which the cleaning step is omitted and the toner is recovered simultaneously with the development.

An electrophotographic photosensitive body, dielectric recording body, and the like, may be used as the aforementioned latent image retaining body.

In case of an electrophotographic photosensitive body, the surface of the electrophotographic photosensitive body is uniformly charged with a corotron charger, contact charger, and the like, and an electrostatic latent image is formed by light exposure (latent image formation step). Then, a development roll having formed thereon a developer layer is brought into contact or to the vicinity of the latent image to thereby attach the toner particles on the electrostatic latent image and forming a toner image on the electrophotographic photosensitive body (development step). Then, the toner image is transferred to the surface of the transfer body, which is then thermally fixed by the fixing machine (fixing step) to obtain the final toner image.

In order to prevent from causing offset and the like upon thermal fixing in the fixing device above, in general, a releasing agent is supplied to the fixing member equipped in the fixing device.

EXAMPLES

The present invention is described in detail by making reference to examples, but it should be understood that the present invention is not only limited thereto. In the description, the term "parts" signifies "parts by weight" unless otherwise stated.

Furthermore, in the present examples, the toner was formed by separately preparing the following resin particles dispersion, colorant particles dispersion, and releasing agent particles dispersion, followed by mixing at a predetermined ratio, and by forming aggregated particles by ionic neutralization, i.e., by adding a polymer of metallic salt while stirring. Then, after adjusting the pH of the system from weakly acidic to neutral by adding an inorganic hydroxide, the resulting product was heated to a temperature not lower than the glass transition temperature or the melting point of the resin particles to obtain the aggregated and coalesced particles. Upon completion of the reaction, the product was subjected to steps of thorough rinsing, solid-liquid separation, and drying to obtain the desired toner.

<Measuring of the Onset Temperature, Glass Transition Temperature, Melting Point, Maximum Melting Endothermic>

Measurements were carried out by using a differential scanning calorimeter (DSC). Specifically, DSC50, manufactured by Shimadzu Corporation, was used for the measurement.

Sample mass: 3 to 15 mg, preferably, 5 to 10 mg.

Method of measurement: The sample is placed ins an aluminum pan, and an empty aluminum pan is used as a reference.

Temperature profile: Heating I (from 20 to 180° C., at a heating rate of 10° C./min).

Cooling I (from 180 to 10° C., at a cooling rate of 10° C./min)

Heating II (from 10 to 180° C., at a heating rate of 10° C./min).

The first onset temperature is acquired from the endothermic peak obtained on Heating I of the temperature profile. The first onset temperature as referred herein is obtained by drawing a tangential line at the lowest temperature of the temperatures at which the differential values of the endothermic peak curves yield local maxima, and then reading the temperature at which the tangential line of the curve crosses the baseline. That is, in case there are plural endothermic peaks, the onset temperature of the endothermic peak located at the lowest melting point side is regarded as the first onset temperature.

Melting point is obtained by measuring the maximum point of the melting endothermic peak obtained through Heating I.

<Measuring of Average Weight Equivalent Particle Diameter>

The average weight equivalent particle diameter was measured using LA920, manufactured by Horiba, Ltd.

<Measuring Weight Average Molecular Weight>

The weight average molecular weight can be obtained by various methods, and although the results slightly differ depending on the measuring method employed, the measuring method below was used in the present invention.

More specifically, weight average molecular weight Mw was obtained be gel permeation chromatography (GPC) under the following conditions.

That is, a solvent (tetrahydrofuran) was flown at a flow rate of 1.2 ml per minute, and 3 mg of a tetrahydrofuran solution containing the sample at a concentration of 0.2 g/20 ml was injected for the measurement. For the measurement of the molecular weight, measuring conditions were selected in such a manner that the count number obtained for the molecular weight of the present sample yields a linear relationship with the logarithm of the calibration line drawn on the molecular weight obtained from various types of monodisperse polystyrene standard samples.

The reliability of the measured results was confirmed from the fact that the NBS706 polystyrene sample measured under the above measuring conditions yield:

Weight average molecular weight $Mw=28.8\times10^4$

Number average molecular weight $Mn=13.7\times10^4$

Any column satisfying the conditions above may be used without any limitations, and a desired column can be used. Specifically, TSK-GEL, GMH (produced by Tosoh Corporation) and the like may be used.

The solvent and the measuring temperatures are not limited to the conditions above, and may be changed to proper conditions.

The preparations methods for each of the dispersions are described below.

<Preparation of Dispersion of Non-Crystalline Polyester Resin (A1)>

| | |
|---|---|
| 1,4-cyclohexanedicarboxylic acid | 175 parts by weight |
| Bisphenol A 1 ethylene oxide adduct | 310 parts by weight |
| Dodecylbenzenesulfonic acid | 0.5 parts by weight |

The materials above were mixed, fed into a reactor equipped with a stirrer, and allowed for polycondensation at 120° C. for 10 hours under nitrogen atmosphere to obtain a non-crystalline polyester resin with uniform and transparent appearance. The weight average molecular weight as measured by GPC was 12,000, and the glass transition temperature was 55° C.

Then, as a surfactant, 0.5 parts by weight of soft sodium dodecylbenzenesulfonate was added to 100 parts by weight of the resin thus obtained, and after adding 300 parts by weight of ion-exchanged water, the resulting product was thoroughly mixed and dispersed in a round-bottom flask while heating to 80° C. using a homogenizer (Ultra Turrax T50, manufactured by IKA Analysentechnik GmbH). Then, after adjusting the pH inside the system to 7.5 using a 0.5 mol/liter aqueous sodium hydroxide solution, further heating to 90° C. was continued while stirring with the homogenizer to obtain the non-crystalline polyester resin particles dispersion (A1) having an average weight equivalent particle size of 210 nm and a solid content of 20%.

<Preparation of Dispersion of Non-Crystalline Polyester Resin (A2)>

| | |
|---|---|
| 1,4-phenylenedipropanic acid | 222 parts by weight |
| Bisphenol A 1 propylene oxide adduct | 344 parts by weight |
| p-toluenesulfonic acid | 0.7 parts by weight |

The materials above were mixed, fed into a reactor equipped with a stirrer, and allowed for polycondensation at 120° C. for 10 hours under nitrogen atmosphere to obtain a non-crystalline polyester resin with uniform and transparent appearance. The weight average molecular weight as measured by GPC was 16,000, and the glass transition temperature was 51° C.

Then, as a surfactant, 0.5 parts by weight of soft sodium dodecylbenzenesulfonate was added to 100 parts by weight of the resin thus obtained, and after adding 300 parts by weight of ion-exchanged water, the resulting product was thoroughly mixed and dispersed in a round-bottom flask using a homogenizer (Ultra Turrax T50, manufactured by IKA Analysentechnik GmbH). Then, after adjusting the pH inside the system to 7.5 using a 0.5 mol/liter aqueous sodium hydroxide solution, further heating to 90° C. while stirring with the homogenizer was continued to obtain the non-crystalline polyester resin particles dispersion (A2) having an average weight equivalent particle size of 150 nm and a solid content of 20%.

<Preparation of Dispersion of Crystalline Polyester Resin (C1)>

| | |
|---|---|
| Dodecylbenzenesulfonic acid | 0.36 parts by weight |
| 1,6-hexanediol | 59 parts by weight |
| Sebacic acid | 101 parts by weight |

The materials above were mixed in a flask, and the mixture was molten by heating at 130° C. on a mantle heater. Thus, a viscous molten product was obtained by retaining the molten mixture at 80° C. for 4 hours while stirring with a THREE ONE MOTOR (Heidon) and degassing.

Then, an aqueous solution for neutralization prepared by dissolving 2.0 parts by weight of 1N NaOH in 650 parts by weight of ion-exchanged water, which was heated similarly to 80° C., was fed into the flask, and after carrying out emulsification for 5 minutes using a homogenizer (Ultra Turrax, manufactured by IKA Analysentechnik GmbH), the flask was cooled with water at room temperature. Thus was obtained a crystalline polyester resin particles dispersion (C1) having an average weight equivalent particle size of 260 nm, a melting point of 69° C., a weight average molecular weight of 5,200, and a solid content of 20%.

<Preparation of Dispersion of Crystalline Polyester Resin (C2)>

The following were mixed and dissolved to obtain an aqueous solution:

| | |
|---|---|
| Dodecylbenzenesulfonic acid | 3.6 parts by weight |
| Ion-exchanged water | 970 parts by weight |

Then, the materials below were mixed, heated to 120° C. and molten. The resulting product was added in the aqueous solution of dodecylbenzenesulfonic acid prepared above, which was emulsified for 5 minutes using a homogenizer (Ultra Turrax, manufactured by IKA Analysentechnik GmbH), followed by further emulsification in an ultrasonic bath for 5 minutes, and maintained at 70° C. in a flask while stirring the emulsion for 15 hours.

| | |
|---|---|
| 1,9-Nonanediol | 80 parts by weight |
| 1,10-Decamethylenedicarboxylic acid | 115 parts by weight |

Thus was obtained a crystalline polyester resin particles dispersion (C2) having an average weight equivalent particle size of 350 nm, a melting point of 70° C., a weight average molecular weight of 4,500, and a solid content of 20%.

<Preparation of Dispersion of Crystalline Polyester Resin (C3)>

The following were mixed and dissolved to obtain an aqueous solution:

| | |
|---|---|
| Dodecylsulfuric acid | 3 parts by weight |
| Ion-exchanged water | 900 parts by weight |

Then, the materials below were mixed, heated to 110° C. and molten. The resulting product was added in the aqueous solution of dodecylsulfuric acid prepared above, which was emulsified for 5 minutes using a homogenizer (Ultra Turrax, manufactured by IKA Analysentechnik GmbH), followed by further emulsification in an ultrasonic bath for 5 minutes, and maintained in a flask at 70° C. while stirring the emulsion for 15 hours.

| | |
|---|---|
| 1,9-Nonanediol | 80 parts by weight |
| Azelaic acid | 94 parts by weight |

Thus was obtained a crystalline polyester resin particles dispersion (C3) having an average weight equivalent particle size of 320 nm, a melting point of 55° C., a weight average molecular weight of 4,800, and a solid content of 20%.

<Preparation of Dispersion of Crystalline Polyester Resin (C4)>

A crystalline polyester resin particles dispersion (C4) having an average weight equivalent particle size of 120 nm, a melting point of 69° C., a weight average molecular weight of 5,200, and a solid content of 20%, was obtained by following the preparation method of dispersion of crystalline polyester resin (C1), except for further effecting emulsification at 100° C. with a Golin homogenizer after carrying out homogenization for 5 minutes using a homogenizer (Ultra Turrax, manufactured by IKA Analysentechnik GmbH).

<Preparation of Dispersion of Crystalline Polyester Resin (C5)>

A crystalline polyester resin particles dispersion (C5) having an average weight equivalent particle size of 200 nm, a melting point of 69° C., a weight average molecular weight of 11,000, and a solid content of 20%, was obtained by following the preparation method of dispersion of crystalline polyester resin of Example 1, except for further effecting emulsification at 100° C. with a Golin homogenizer after carrying out melting of the mixture, retaining the molten mixture at 80° C. for 10 hours while stirring with a THREE ONE MOTOR (Heidon) and degassing, and emulsifying for 5 minutes using a homogenizer (Ultra Turrax, manufactured by IKA Analysentechnik GmbH).

<Preparation of Releasing Agent Particles Dispersion (W1)>

The following were mixed and dissolved to obtain an aqueous solution:

| | |
|---|---|
| Dodecylsulfuric acid | 30 parts by weight |
| Ion-exchanged water | 852 parts by weight |

Then, the materials below were mixed, heated to 250° C. and molten. The resulting product was added in the aqueous solution of dodecylsulfuric acid prepared above, which was emulsified for 5 minutes using a homogenizer (Ultra Turrax, manufactured by IKA Analysentechnik GmbH), followed by further emulsification in an ultrasonic bath for 5 minutes, and maintained in a flask at 70° C. while stirring the emulsion for 15 hours.

| | |
|---|---|
| Palmitic acid | 188 parts by weight |
| Pentaerythrithol | 25 parts by weight |

Thus was obtained a releasing agent particles dispersion (W1) having an average weight equivalent particle size of 310 nm, a melting point of 72° C., and a solid content of 20%.

<Preparation of Releasing Agent Particles Dispersion (W2)>

Anionic surfactant 2 parts by weight (Neogen R, produced by DAI-ICHI KOGYO SEIYAKU CO., LTD.)

| | |
|---|---|
| Ion-exchanged water | 800 parts by weight |
| Carnauba wax | 200 parts by weight |

The materials above were mixed, heated to 100° C. and molten. The resulting product was emulsified for 5 minutes using a homogenizer (Ultra Turrax, manufactured by IKA Analysentechnik GmbH), followed by further emulsification at 100° C. using a Golin homogenizer.

Thus was obtained a releasing agent particles dispersion (W2) having an average weight equivalent particle size of 250 nm, a melting point of 83° C., and a solid content of 20%.

<Preparation of Releasing Agent Particles Dispersion (W3)>

A releasing agent particles dispersion (W3) having an average weight equivalent particle size of 130 nm was prepared by following the preparation of releasing agent particles dispersion (W1), except for further carrying out emulsification at 90° C. using a Golin homogenizer after the emulsification using an ultrasonic bath.

<Preparation of Colorant Particles Dispersion (P1)>

| | |
|---|---|
| Cyan pigment (Copper phthalocyanine B15:3, produced by Dainichiseika Color & Chemicals Mfg. Co., Ltd) | 50 parts by weight |
| Anionic surfactant (Neogen R, produced by DAI-ICHI KOGYO SEIYAKU CO., LTD.) | 5 parts by weight |
| Ion-exchanged water | 200 parts by weight |

The components above were mixed and dissolved, and the resulting product was stirred for 5 minutes using a homogenizer (Ultra Turrax, manufactured by IKA Analysentechnik GmbH), and dispersed for 10 minutes using an ultrasonic bath to thereby obtain a cyan colorant particles dispersion (P1) having an average weight equivalent particle size of 190 nm and a solid content of 21.5%.

<Preparation of Colorant Particles Dispersion (P2)>

A magenta colorant particles dispersion (P2) having an average weight equivalent particle size of 165 nm, and a solid content of 21.5% was obtained in the same manner as in the preparation of colorant particles dispersion (P1), except for using a magenta pigment (PR122, produced by Dainippon Ink and Chemicals, Incorporated).

Example 1

<Preparation of Toner Particles>

| | |
|---|---|
| Non-crystalline polyester resin dispersion (A1) | 210 parts by weight (42 parts by weight resin) |
| Crystalline polyester resin dispersion (C1) | 50 parts by weight (21 parts by weight resin) |
| Colorant particles dispersion (P1) | 40 parts by weight (8.6 parts by weight resin) |
| Releasing agent particles dispersion (W1) | 40 parts by weight (8.6 parts by weight releasing agent) |
| Polyaluminum chloride | 0.15 parts by weight |
| Ion-exchanged water | 300 parts by weight |

The components above were thoroughly mixed and dispersed in a round-bottom stainless flask using a homogenizer (Ultra Turrax T50, manufactured by IKA Analysentechnik GmbH), followed by heating to 42° C. under stirring the contents of the flask on a heating oil bath, and the mixture was held for 60 minutes at 42° C. Then, 50 parts by weight of the non-crystalline polyester resin dispersion (A1) (corresponding to 21 parts by weight of resin) was added and stirred mildly.

Then, after adjusting the pH of the system to 6.0 by using a 0.5 mol/liter aqueous sodium hydroxide solution, the product was heated to 80° C. while continuing stirring.

During heating to 80° C., in general, the pH of the system drops to 5.0, but in this case, the pH of the system was prevented from decreasing to 5.5 or lower by adding dropwise a sodium hydroxide aqueous solution.

Upon completion of the reaction, the contents of the flask were cooled to 55° C., and after maintaining at the temperature for 3 hours, cooled again to room temperature. The resulting product was filtered, thoroughly washed with ion exchanged water, and subjected to solid-liquid separation by Nutsche suction filtration. The resulting product was again dispersed in 3 liters of ion exchanged water at 40° C., and then washed by stirring at 300 rpm for 15 minutes. The washing operation was repeated 5 times, and the product was then subjected to solid-liquid separation by Nutsche suction filtration, followed by vacuum drying for 12 hours to obtain toner particles. On measuring the toner particles with a Coulter counter, they were found to have an average equivalent volumetric particle diameter $D_{50}$ of 4.6 μm, and geometric standard deviation based on volume GSDv of 1.20. The shape factor SF1 of the toner particles obtained by shape observation with a LUZEX image analyzer was 130, which indicated a potato-like shape.

By DSC measurements, the first onset temperature as a toner was found to be 54° C., and the maximum melting endothermic point was 71° C.

<Preparation of External Addition Toner>

A cyan external addition toner was prepared using a Hentshel mixer, by mixing 1% by weight each of fine particles of silica ($SiO_2$) having an average primary particle diameter of 40 nm, which were subjected to a treatment for rendering the surface hydrophobic using hexamethyldisilazane (sometimes abbreviated hereinafter as "HMDS"), with fine particles of metatitanate compound obtained as a reaction product of metatitanic acid and isobutyltrimethoxysilane, and having an average primary particle diameter of 20 nm.

<Preparation of Carrier>

A methanol solution containing 0.1 parts by weight of γ-aminopropyltriethoxysilane was added to 100 parts by weight of Cu—Zn ferrite fine powder having an average equivalent volumetric particle diameter of 40 μm, and after operating a kneader for covering the particles, methanol was distilled away. Then, the silane compound was completely hardened by heating the resulting product at 120° C. for 2 hours.

Perfluorooctylethyl methacrylate-methyl methacrylate copolymer (having a copolymerization ratio of 40:60) dissolved in toluene was added to the resulting particles, and a resin-coated carrier having a perfluorooctylethyl methacrylate-methyl methacrylate copolymer coverage of 0.5% by weight was produced by using a vacuum evacuation type kneader.

<Production of Developer>

Five parts by weight each of the toners prepared above was mixed for 20 minutes with 100 parts by weight of thus obtained resin-coated carrier in a V-shape blender to produce an electrostatic charge image developer. The developer thus prepared was used as the developer in the following evaluation.

<Toner Evaluation>

The fixing properties were evaluated by using the foregoing developer with a modified machine of DocuCentreColor500, using a J-coat paper produced by Fuji Xerox Co., Ltd. as transfer paper and adjusting the process speed to 180 mm/sec. The oil less fixing property using a PFA tube fixing roll was favorable, and it was confirmed that the image exhibits sufficient fixing property at a fixing temperature (this temperature was evaluated by contamination of an image upon rubbing the image with a cloth) of 115° C. or higher (i.e., the lowest fixing temperature is 115° C.). Good developing property and transfer property were obtained, exhibiting a favorable high quality initial image (Fine) free of image defects.

In the modified machine above, continuous printing test was performed on 50,000 sheets under high temperature and high humidity conditions of 30° C. and 80% RH, to show that the favorable high quality initial image was retained through the entire test, free from generation of filming on the photosensitive body (Fine high temperature and high humidity image quality).

The toners were evaluated based on the following standards:

A. Initial image quality evaluation standards

Images were formed under the conditions above, and the initial image quality was evaluated in accordance with the following standards.

Fine—Extremely favorable results on image density, stains on background, fine line reproducibility (no image defects)

Fair—Slightly inferior results but no practical problem on image density, stains on background, fine line reproducibility (some image defects are present)

Poor—Inferior results on one of mage density, stains on background, fine line reproducibility (distinct image defects are present)

B. High temperature and high humidity image quality

As described in the foregoing, continuous printing test was performed on 50,000 sheets under high temperature and high humidity conditions of 30° C. and 80% RH, and evaluation was made under the following standards.

Fine—Fine image quality maintained, no generation of filming found on the photosensitive body Fair—Fine image quality maintained for 50,000 sheets, but slight generation of filming found on the photosensitive body Poor—Deterioration found on image quality. Generation of filming observed on the photosensitive body C. Lowest fixing temperature The lowest fixing temperature was measured as follows. Specifically, the evaluation was made by using a modified machine of DocuCentreColor500, produced by Fuji Xerox Co., Ltd. This machine is of oil-less fixing type, and is equipped with a PFA(perfluoroalkyl vinyl ether copolymer) tube fixing roll as the fixing device. For the evaluation, the process speed was set constant to 180 mm/sec, and a J-coat paper produced by Fuji Xerox Co., Ltd. was used as transfer paper.

For the evaluation of the lowest fixing temperature, fixing was performed by elevating the temperature from 80° C. to 200° C. at a heating ramp of 5° C.

The lowest fixing temperature given in Table 1 was obtained as the lowest temperature at which no contamination generated on an image upon rubbing the image with a cloth.

Each of the evaluation results are given in Table 1 together with the toner raw materials and the physical properties and the like.

Examples 2 to 4, Comparative Examples 1 and 2

The crystalline polyester resin particles dispersion, non-crystalline polyester resin particles dispersion, and releasing agent particles dispersion used are shown in Table 1.

The fusion and coalescence temperature are given in Table 1.

In Example 4 and in Comparative Example 2, no temperature hold at 55° C. for 3 hours was performed on the cooling step after fusion and coalescence step.

The results are given in Table 1.

TABLE 1

| | Example 1 | Example 2 | Example 3 | Comp. Example 1 | Comp. Example 2 | Example 4 |
|---|---|---|---|---|---|---|
| Non-crystalline polyester resin dispersion | A1 | A1 | A2 | A1 | A1 | A1 |
| Half bandwidth of Endothermic peak (° C.) | none | none | none | none | none | none |
| Tg (° C.) | 55 | 55 | 51 | 55 | 55 | 55 |
| Mw | 12,000 | 12,000 | 16,000 | 12,000 | 12,000 | 12,000 |
| Particle diameter (nm) | 210 | 210 | 150 | 210 | 210 | 210 |
| Crystalline polyester resin dispersion | C1 | C2 | C3 | C4 | C5 | C1 |

TABLE 1-continued

| | Example 1 | Example 2 | Example 3 | Comp. Example 1 | Comp. Example 2 | Example 4 |
|---|---|---|---|---|---|---|
| Half bandwidth of Endothermic peak (° C.) | 6 | 8 | 13 | 6 | 6 | 6 |
| Melting point (° C.) | 69 | 70 | 55 | 69 | 69 | 69 |
| Mw | 5,200 | 4,500 | 4,800 | 5,200 | 11,000 | 5,200 |
| Particle diameter (nm) | 260 | 350 | 320 | 120 | 200 | 260 |
| Type of releasing agent | W1 | W2 | W2 | W3 | W1 | W1 |
| Melting point (° C.) | 72 | 83 | 83 | 72 | 72 | 72 |
| Particle diameter (nm) | 310 | 250 | 250 | 130 | 310 | 310 |
| Colorant | P1 | P1 | P2 | P1 | P1 | P1 |
| Fusion and coalescence temperature (° C.) | 80 | 90 | 90 | 95 | 95 | 80 |
| Cooling condition | Holding at 55° C. for 3 hrs | Holding at 55° C. for 3 hrs | Holding at 55° C. for 3 hrs | Holding at 55° C. for 3 hrs | None | None |
| $D_{50}$ (μm) | 4.6 | 4.8 | 4.7 | 4.6 | 4.5 | 4.9 |
| GSD v | 1.20 | 1.21 | 1.20 | 1.22 | 1.20 | 1.21 |
| SF1 | 130 | 125 | 126 | 124 | 126 | 131 |
| DSC first onset temperature (° C.) on the lower temperature side for toner | 54 | 53 | 50 | 42 | 45 | 48 |
| Melting point (° C.) of releasing agent contained in toner | 71 | 81 | 81 | 68 | 67 | 68 |
| Lowest fixing temperature (° C.) | 115 | 115 | 105 | 110 | 125 | 115 |
| Initial image quality | Fine | Fine | Fine | Fair | Fair | Fair |
| High temperature high humidity image quality | Fine | Fine | Fine | Poor | Poor | Fair |

According to the present invention, a method capable of producing a toner for developing electrostatic charge image having excellent low temperature fixing properties and long term preservability of high quality images at low production energy can be provided. In particular, a method for producing a toner for developing elec. having superior long term preservability under high temperature and high humidity conditions is provided.

Additionally, according to the present invention, a toner for developing electrostatic charge image obtained by the method above and a developer using the toner, and a method for forming image using the toner and the developer are provided.

The entire disclosure of Japanese Patent Application No. 2005-307929 filed on Oct. 24, 2005 including specification, claims and abstract is incorporated herein by reference in its entirety.

What is claimed is:

1. A method of producing a toner for developing an electrostatic charge image, the method comprising:

aggregating particles containing a crystalline polyester resin, particles containing a non-crystalline polyester resin, and particles of a releasing agent in an aqueous medium, so as to form aggregated particles; and heating the aggregated particles to fuse into a coalescent body, wherein:

at least one of the crystalline polyester resin and the non-crystalline polyester resin is obtained by polymerization at temperatures not higher than 150° C. with a Bronsted acid containing a sulfur atom as a catalyst, a first onset temperature A(° C.) of the toner and a glass transition temperature B(° C.) of the non-crystalline polyester resin as measured by differential scanning calorimeter satisfy a relation $(B-A) \leqq 10$, the non-crystalline polyester resin has a weight average molecular weight (Mw) of from 5,000 to 100,000 as measured by a molecular weight measurement of a tetrahydrofuran (THF) soluble component utilizing gel permeation chromatography (GPC), and a weight average molecular weight of the crystalline polyester resin is ½ or lower of a weight average molecular weight of the non-crystalline polyester resin.

2. The method of producing a toner for developing an electrostatic charge image according to claim 1, wherein the toner has the first onset temperature (A) of 50° C. or higher.

3. The method of producing a toner for developing an electrostatic charge image according to claim 1, wherein the non-crystalline polyester resin has a weight average molecular weight (Mw) and a number average molecular weight (Mn) satisfying Mw/Mn of from 1.5 to 100 as measured by a molecular weight measurement of a tetrahydrofuran (THF) soluble component utilizing gel permeation chromatography (GPC).

4. The method of producing a toner for developing an electrostatic charge image according to claim 1, wherein the Bronsted acid catalyst containing a sulfur atom is at least one selected from the group consisting of dodecylbenzenesulfonic acid, benzenesulfonic acid, p-toluenesulfonic acid, and camphorsulfonic acid.

5. The method of producing a toner for developing an electrostatic charge image according to claim 1, wherein at least one selected from the group consisting of a metallic catalyst, a hydrolytic enzyme type catalyst, a basic catalyst, and a Bronsted acid catalyst free of sulfur is used together with the Bronsted acid catalyst containing a sulfur atom.

6. The method of producing a toner for developing an electrostatic charge image according to claim 5, wherein the metallic catalyst is at least one selected from the group consisting of an organotin compound, an organotitanium compound, an organohalogenated tin compound, and a rare earth metallic catalyst.

7. The method of producing a toner for developing an electrostatic charge image according to claim 1, wherein an average weight equivalent particle diameter of the particles containing a crystalline polyester resin and an average weight equivalent particle diameter of the particles of a releasing agent are larger than an average weight equivalent particle diameter of the particles containing a non-crystalline polyester resin.

8. The method of producing a toner for developing an electrostatic charge image according to claim 1, wherein the releasing agent for the toner has a maximum melting endothermic peak in a temperature range of from 70 to 90° C.

9. The method of producing a toner for developing an electrostatic charge image according to claim 8, wherein a heating temperature for the aggregated particles to fuse into a coalescent body is (C+10) (° C.) or lower, where C(° C.) represents a melting point of the particles of a releasing agent.

10. A toner for developing an electrostatic charge image produced by a method according to claim 1.

11. The toner for developing an electrostatic charge image according to claim 10, which has an average equivalent volumetric particle diameter ($D_{50}$) in a range of from 3.0 μm to 20.0 μm.

12. The toner for developing an electrostatic charge image according to claim 10, which has a geometric standard deviation based on volume (GSDv) of 1.4 or lower.

13. The toner for developing an electrostatic charge image according to claim 10, which has a shape factor SF1 in a range of from 100 to 140.

14. The toner for developing an electrostatic charge image according to claim 10, which is obtained by mixing or adding inorganic particles having a primary particle diameter in a range of from 5 nm to 2 μm on a surface of the toner.

15. The toner for developing an electrostatic charge image according to claim 10, which has a specific surface area in a range of 20 to 500 $m^2/g$ as measured in accordance with BET method.

16. An electrostatic charge image developer comprising: a toner for developing an electrostatic charge image according to claim 10; and a carrier.

17. A method for forming an image comprising:

a step of forming a latent image comprising forming an electrostatic latent image on a surface of a latent image retaining body;

a development step comprising forming a toner image by developing the electrostatic latent image formed on the surface of the latent image retaining body by utilizing a toner or an electrostatic charge image developer;

a step of transferring the toner image formed on the surface of the latent image retaining body to a surface of an image transfer body; and a fixing step comprising thermally fixing the toner image transferred to the surface of the image transfer body, wherein the toner is a toner for developing an electrostatic charge image according to claim 10.

* * * * *